US007246058B2

(12) United States Patent
Burnett

(10) Patent No.: US 7,246,058 B2
(45) Date of Patent: Jul. 17, 2007

(54) DETECTING VOICED AND UNVOICED SPEECH USING BOTH ACOUSTIC AND NONACOUSTIC SENSORS

(75) Inventor: Gregory C. Burnett, Livermore, CA (US)

(73) Assignee: Aliph, Inc., San Francisco, CA (US)

( * ) Notice: Subject to any disclaimer, the term of this patent is extended or adjusted under 35 U.S.C. 154(b) by 688 days.

(21) Appl. No.: 10/159,770

(22) Filed: May 30, 2002

(65) Prior Publication Data

US 2002/0198705 A1 Dec. 26, 2002

Related U.S. Application Data

(60) Provisional application No. 60/294,383, filed on May 30, 2001, provisional application No. 60/335,100, filed on Oct. 30, 2001, provisional application No. 60/332,202, filed on Nov. 21, 2001, provisional application No. 60/362,162, filed on Mar. 5, 2002, provisional application No. 60/362,103, filed on Mar. 5, 2002, provisional application No. 60/362,170, filed on Mar. 5, 2002, provisional application No. 60/361,981, filed on Mar. 5, 2002, provisional application No. 60/362,161, filed on Mar. 5, 2002, provisional application No. 60/368,209, filed on Mar. 27, 2002, provisional application No. 60/368,208, filed on Mar. 27, 2002, provisional application No. 60/368,343, filed on Mar. 27, 2002.

(51) Int. Cl.
*G10L 11/06* (2006.01)

(52) U.S. Cl. ..... 704/226; 704/214

(58) Field of Classification Search ..... None
See application file for complete search history.

(56) References Cited

U.S. PATENT DOCUMENTS 3,789,166 A 1/1974 Sebesta (Continued)

FOREIGN PATENT DOCUMENTS

EP 0 637 187 A 2/1995

(Continued)

OTHER PUBLICATIONS

Gregory C. Burnett: "The Physiological Basis of Glottal Electromagnetic Micropower Sensors (GEMS) and Their Use in Defining an Excitation Function for the Human Vocal Tract", Dissertation, University of California at Davis, Jan. 1999, USA.

(Continued)

*Primary Examiner*—Abul K. Azad
(74) *Attorney, Agent, or Firm*—Courtney Staniford & Gregory LLP

(57) ABSTRACT

Systems and methods are provided for detecting voiced and unvoiced speech in acoustic signals having varying levels of background noise. The systems receive acoustic signals at two microphones, and generate difference parameters between the acoustic signals received at each of the two microphones. The difference parameters are representative of the relative difference in signal gain between portions of the received acoustic signals. The systems identify information of the acoustic signals as unvoiced speech when the difference parameters exceed a first threshold, and identify information of the acoustic signals as voiced speech when the difference parameters exceed a second threshold. Further, embodiments of the systems include non-acoustic sensors that receive physiological information to aid in identifying voiced speech.

5 Claims, 10 Drawing Sheets

U.S. PATENT DOCUMENTS

| | | | | | |
|---|---|---|---|---|---|
| 4,006,318 | A | | 2/1977 | Sebesta et al. | |
| 4,591,668 | A | | 5/1986 | Iwata | |
| 4,653,102 | A | * | 3/1987 | Hansen | 381/92 |
| 4,777,649 | A | * | 10/1988 | Carlson et al. | 704/233 |
| 4,901,354 | A | | 2/1990 | Gollmar et al. | |
| 5,097,515 | A | | 3/1992 | Baba | |
| 5,212,764 | A | | 5/1993 | Ariyoshi | |
| 5,400,409 | A | | 3/1995 | Linhard | |
| 5,406,622 | A | | 4/1995 | Silverberg et al. | |
| 5,414,776 | A | | 5/1995 | Sims, Jr. | |
| 5,473,702 | A | | 12/1995 | Yoshida et al. | |
| 5,515,865 | A | | 5/1996 | Scanlon et al. | |
| 5,517,435 | A | | 5/1996 | Sugiyama | |
| 5,539,859 | A | | 7/1996 | Robbe et al. | |
| 5,590,241 | A | * | 12/1996 | Park et al. | 704/227 |
| 5,633,935 | A | | 5/1997 | Kanamori et al. | |
| 5,649,055 | A | | 7/1997 | Gupta et al. | |
| 5,664,052 | A | * | 9/1997 | Nishiguchi et al. | 704/214 |
| 5,684,460 | A | | 11/1997 | Scanlon et al. | |
| 5,729,694 | A | | 3/1998 | Holzrichter et al. | |
| 5,754,665 | A | | 5/1998 | Hosoi et al. | |
| 5,835,608 | A | | 11/1998 | Warnaka et al. | |
| 5,853,005 | A | | 12/1998 | Scanlon | |
| 5,917,921 | A | | 6/1999 | Sasaki et al. | |
| 5,966,090 | A | | 10/1999 | McEwan | |
| 5,986,600 | A | | 11/1999 | McEwan | |
| 6,006,175 | A | * | 12/1999 | Holzrichter | 704/208 |
| 6,009,396 | A | | 12/1999 | Nagata | |
| 6,069,963 | A | | 5/2000 | Martin et al. | |
| 6,191,724 | B1 | | 2/2001 | McEwan | |
| 6,233,551 | B1 | * | 5/2001 | Cho et al. | 704/208 |
| 6,266,422 | B1 | | 7/2001 | Ikeda | |
| 6,430,295 | B1 | | 8/2002 | Handel et al. | |
| 2002/0039425 | A1 | | 4/2002 | Burnett et al. | |

FOREIGN PATENT DOCUMENTS

| | | |
|---|---|---|
| EP | 0 795 851 A2 | 9/1997 |
| EP | 0 984 660 A2 | 3/2000 |
| JP | 2000 312 395 | 11/2000 |
| JP | 2001 189 987 | 7/2001 |
| WO | WO 02 07151 | 1/2002 |

OTHER PUBLICATIONS

Todd J. Gable et al.: "Speaker Verification Using Combined Acoustic and EM Sensor Signal Processing", IEEE Intl. Conf. on Acoustics, Speech & Signal Processing (ICASSP-2001), Salt Lake City, USA, 2001.

A. Hussain: "Intelligibility Assessment of a Multi-Band Speech Enhancement Scheme", Proceedings IEEE Intl. Conf. on Acoustics, Speech & Signal Processing (ICASSP-2000). Istanbul, Turkey, Jun. 2000.

Zhao Li et al: "Robust Speech Coding Using Microphone Arrays", Signals Systems and Computers, 1997. Conf. record of 31st Asilomar Conf., Nov. 2-5, 1997, IEEE Comput. Soc. Nov. 2, 1997, USA.

L.C. Ng et al.: "Denoising of Human Speech Using Combined Acoustic and EM Sensor Signal Processing", 2000 IEEE Intl Conf on Acoustics Speech and Signal Processing. Proceedings (Cat. No. 00CH37100), Istanbul, Turkey, Jun. 5-9, 2000, XP002186255, ISBN 0-7803-6293-4.

S. Affes et al.: "A Signal Subspace Tracking Algorithm for Microphone Array Processing of Speech". IEEE Transactions on Speech and Audio Processing, N.Y, USA vol. 5, No. 5, Sep. 1, 1997, XP000774303, ISBN 1063-6676.

* cited by examiner

Figure 5A
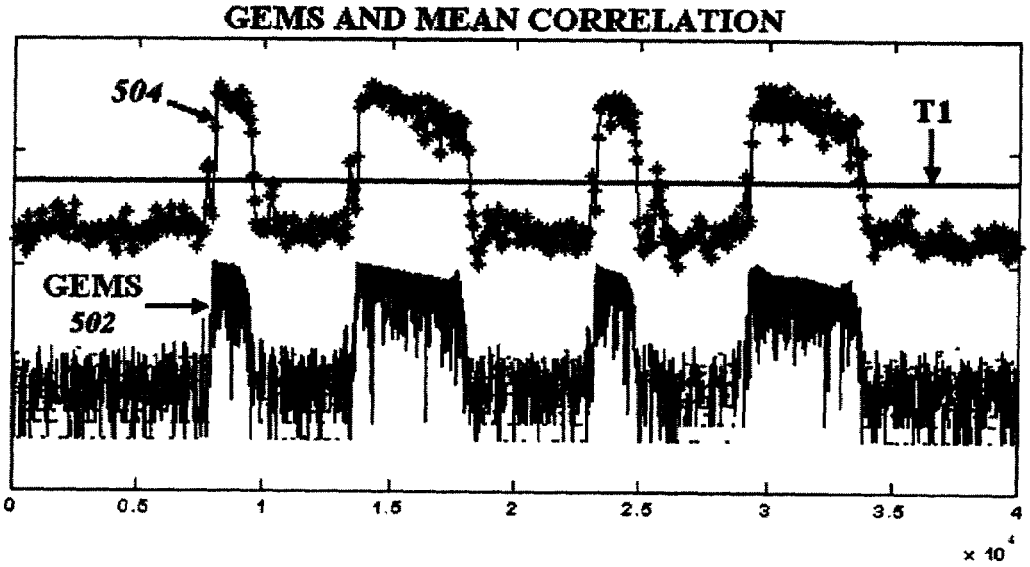
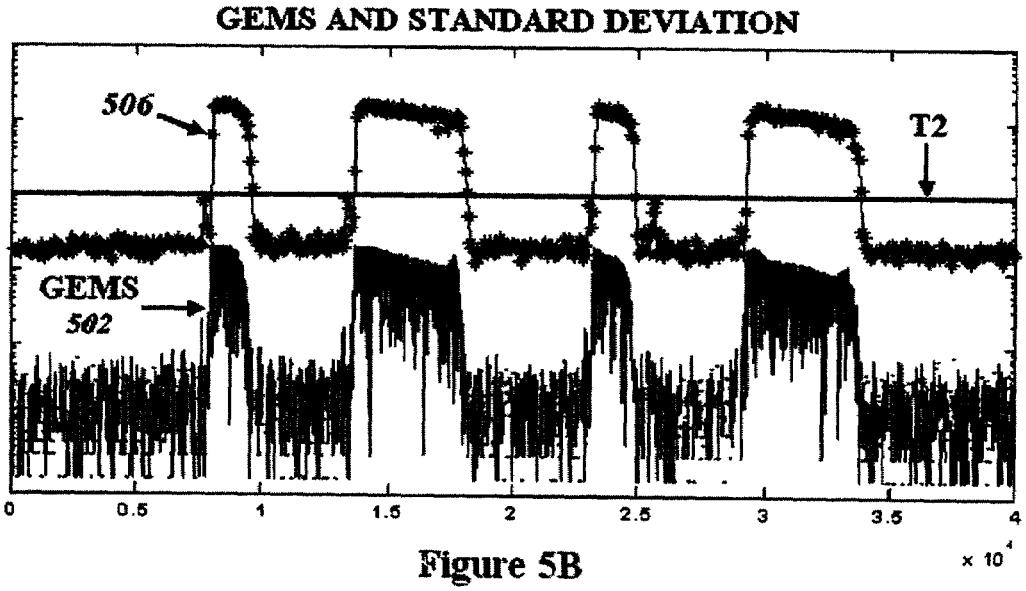
Figure 5B

DETECTING VOICED AND UNVOICED SPEECH USING BOTH ACOUSTIC AND NONACOUSTIC SENSORS

RELATED APPLICATIONS

This application claims the benefit of U.S. application Nos. 60/294,383 filed May 30, 2001; 09/905,361 filed Jul. 12, 2001; 60/335,100 filed Oct. 30, 2001; 60/332,202 and 09/990,847, both filed Nov. 21, 2001; 60/362,103, 60/362,161, 60/362,162, 60/362,170, and 60/361,981, all filed Mar. 5, 2002; 60/368,208, 60/368,209, and 60/368,343, all filed Mar. 27, 2002; all of which are incorporated herein by reference in their entirety.

TECHNICAL FIELD

The disclosed embodiments relate to the processing of speech signals.

BACKGROUND

The ability to correctly identify voiced and unvoiced speech is critical to many speech applications including speech recognition, speaker verification, noise suppression, and many others. In a typical acoustic application, speech from a human speaker is captured and transmitted to a receiver in a different location. In the speaker's environment there may exist one or more noise sources that pollute the speech signal, or the signal of interest, with unwanted acoustic noise. This makes it difficult or impossible for the receiver, whether human or machine, to understand the user's speech.

Typical methods for classifying voiced and unvoiced speech have relied mainly on the acoustic content of microphone data, which is plagued by problems with noise and the corresponding uncertainties in signal content. This is especially problematic now with the proliferation of portable communication devices like cellular telephones and personal digital assistants because, in many cases, the quality of service provided by the device depends on the quality of the voice services offered by the device. There are methods known in the art for suppressing the noise present in the speech signals, but these methods demonstrate performance shortcomings that include unusually long computing time, requirements for cumbersome hardware to perform the signal processing, and distorting the signals of interest.

BRIEF DESCRIPTION OF THE FIGURES

FIG. 5A plots the received GEMS signal for an utterance along with the mean correlation between the GEMS signal and the Mic 1 signal and the threshold for voiced speech detection.

FIG. 5B plots the received GEMS signal for an utterance along with the standard deviation of the GEMS signal and the threshold for voiced speech detection.

In the figures, the same reference numbers identify identical or substantially similar elements or acts.

Any headings provided herein are for convenience only and do not necessarily affect the scope or meaning of the claimed invention.

DETAILED DESCRIPTION

Systems and methods for discriminating voiced and unvoiced speech from background noise are provided below including a Non-Acoustic Sensor Voiced Speech Activity Detection (NAVSAD) system and a Pathfinder Speech Activity Detection (PSAD) system. The noise removal and reduction methods provided herein, while allowing for the separation and classification of unvoiced and voiced human speech from background noise, address the shortcomings of typical systems known in the art by cleaning acoustic signals of interest without distortion.

Figure 1:
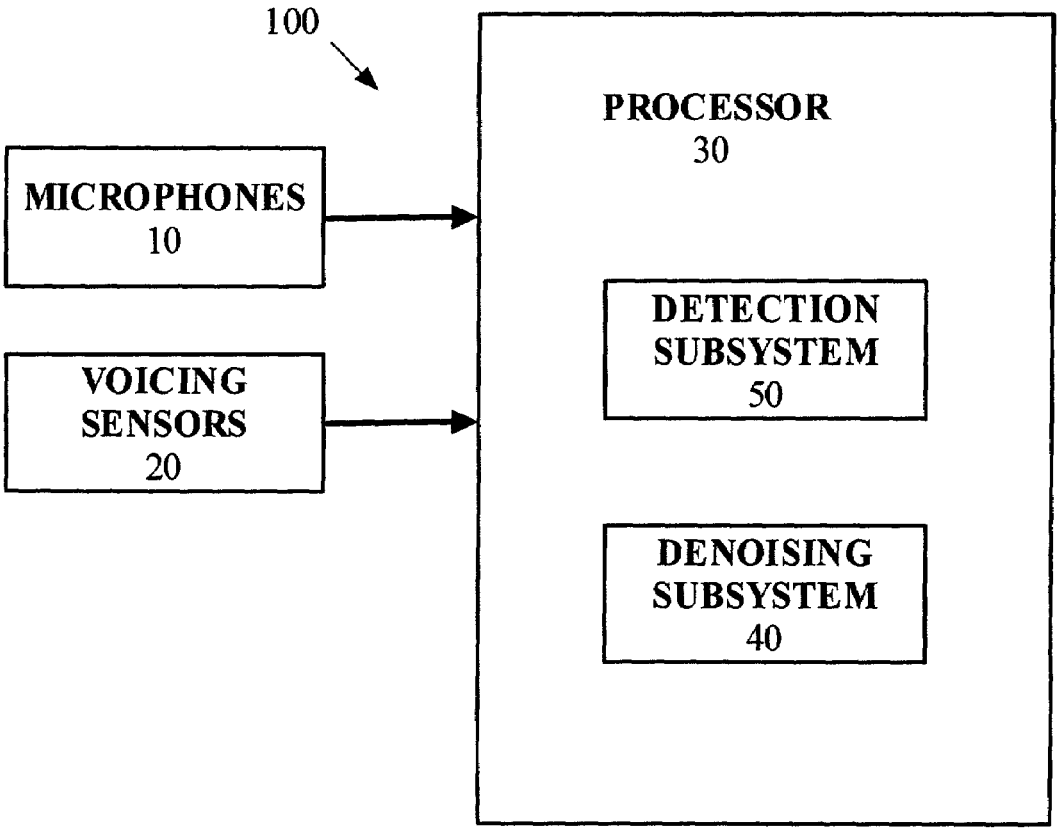
FIG. 1 is a block diagram of a NAVSAD system, under an embodiment.

FIG. 1 is a block diagram of a NAVSAD system 100, under an embodiment. The NAVSAD system couples microphones 10 and sensors 20 to at least one processor 30. The sensors 20 of an embodiment include voicing activity detectors or non-acoustic sensors. The processor 30 controls subsystems including a detection subsystem 50, referred to herein as a detection algorithm, and a denoising subsystem 40. Operation of the denoising subsystem 40 is described in detail in the Related Applications. The NAVSAD system works extremely well in any background acoustic noise environment.

Figure 2:
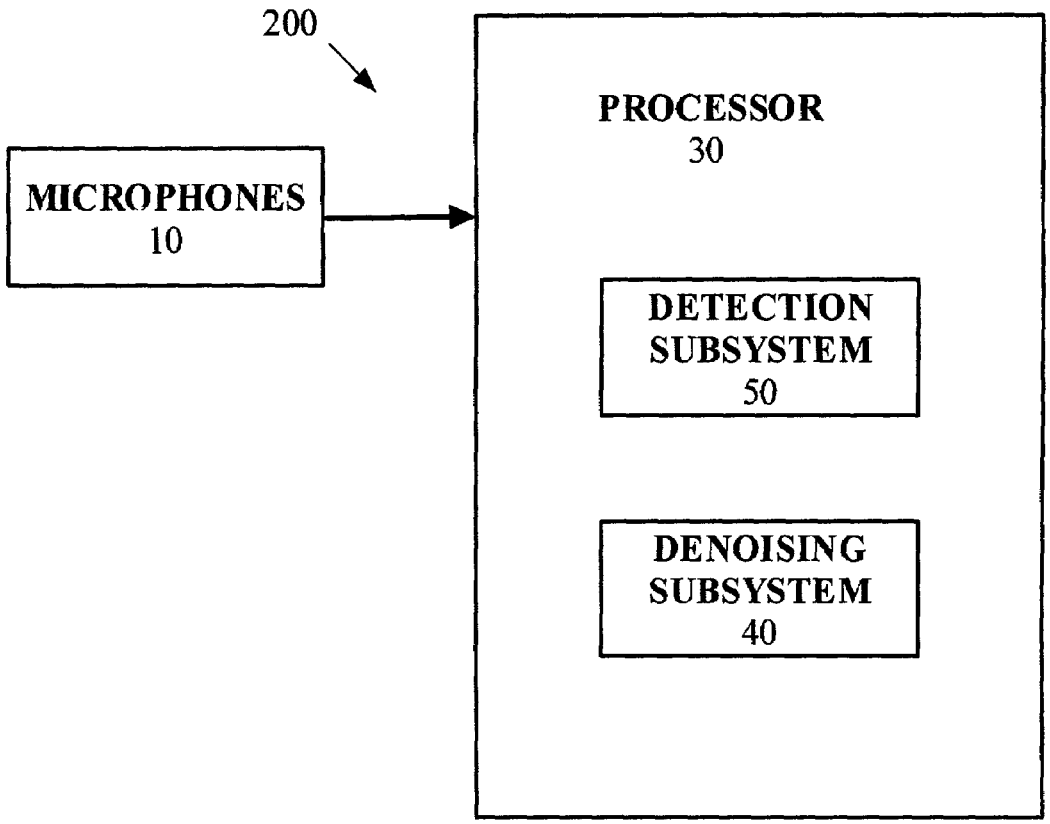
FIG. 2 is a block diagram of a PSAD system, under an embodiment.

FIG. 2 is a block diagram of a PSAD system 200, under an embodiment. The PSAD system couples microphones 10 to at least one processor 30. The processor 30 includes a detection subsystem 50, referred to herein as a detection algorithm, and a denoising subsystem 40. The PSAD system is highly sensitive in low acoustic noise environments and relatively insensitive in high acoustic noise environments. The PSAD can operate independently or as a backup to the NAVSAD, detecting voiced speech if the NAVSAD fails.

Note that the detection subsystems 50 and denoising subsystems 40 of both the NAVSAD and PSAD systems of an embodiment are algorithms controlled by the processor 30, but are not so limited. Alternative embodiments of the NAVSAD and PSAD systems can include detection subsystems 50 and/or denoising subsystems 40 that comprise additional hardware, firmware, software, and/or combinations of hardware, firmware, and software. Furthermore, functions of the detection subsystems 50 and denoising subsystems 40 may be distributed across numerous components of the NAVSAD and PSAD systems.

Figure 3:
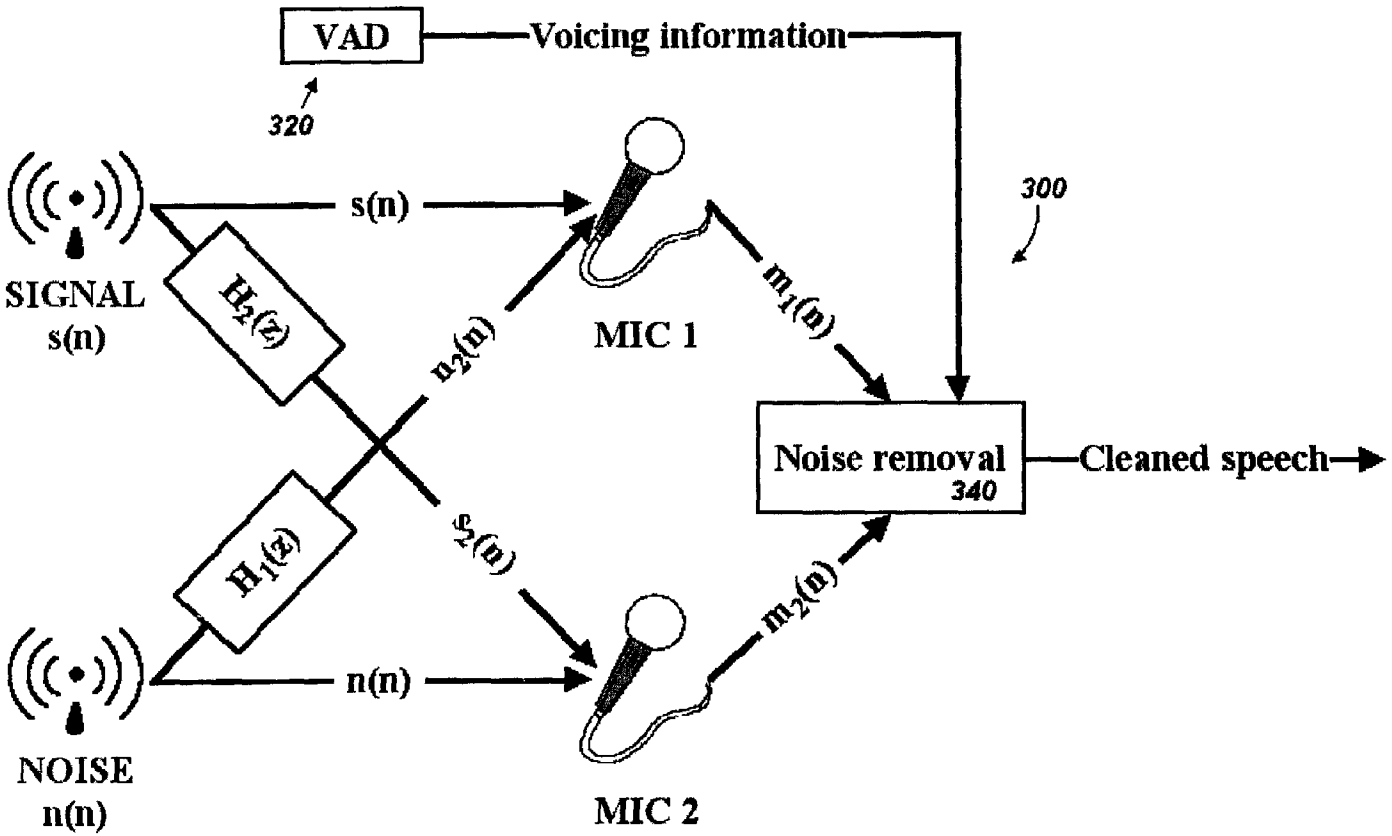
FIG. 3 is a block diagram of a denoising system, referred to herein as the Pathfinder system, under an embodiment.

FIG. 3 is a block diagram of a denoising subsystem 300, referred to herein as the Pathfinder system, under an embodiment. The Pathfinder system is briefly described below, and is described in detail in the Related Applications. Two microphones Mic 1 and Mic 2 are used in the Pathfinder system, and Mic 1 is considered the "signal" microphone. With reference to FIG. 1, the Pathfinder system 300 is equivalent to the NAVSAD system 100 when the voicing activity detector (VAD) 320 is a non-acoustic voicing sensor 20 and the noise removal subsystem 340 includes the detection subsystem 50 and the denoising subsystem 40. With reference to FIG. 2, the Pathfinder system 300 is equivalent to the PSAD system 200 in the absence of the VAD 320, and when the noise removal subsystem 340 includes the detection subsystem 50 and the denoising subsystem 40.

The NAVSAD and PSAD systems support a two-level commercial approach in which (i) a relatively less expensive PSAD system supports an acoustic approach that functions in most low- to medium-noise environments, and (ii) a NAVSAD system adds a non-acoustic sensor to enable detection of voiced speech in any environment. Unvoiced speech is normally not detected using the sensor, as it normally does not sufficiently vibrate human tissue. However, in high noise situations detecting the unvoiced speech is not as important, as it is normally very low in energy and easily washed out by the noise. Therefore in high noise environments the unvoiced speech is unlikely to affect the voiced speech denoising. Unvoiced speech information is most important in the presence of little to no noise and, therefore, the unvoiced detection should be highly sensitive in low noise situations, and insensitive in high noise situations. This is not easily accomplished, and comparable acoustic unvoiced detectors known in the art are incapable of operating under these environmental constraints.

The NAVSAD and PSAD systems include an array algorithm for speech detection that uses the difference in frequency content between two microphones to calculate a relationship between the signals of the two microphones. This is in contrast to conventional arrays that attempt to use the time/phase difference of each microphone to remove the noise outside of an "area of sensitivity". The methods described herein provide a significant advantage, as they do not require a specific orientation of the array with respect to the signal.

Further, the systems described herein are sensitive to noise of every type and every orientation, unlike conventional arrays that depend on specific noise orientations. Consequently, the frequency-based arrays presented herein are unique as they depend only on the relative orientation of the two microphones themselves with no dependence on the orientation of the noise and signal with respect to the microphones. This results in a robust signal processing system with respect to the type of noise, microphones, and orientation between the noise/signal source and the microphones.

The systems described herein use the information derived from the Pathfinder noise suppression system and/or a non-acoustic sensor described in the Related Applications to determine the voicing state of an input signal, as described in detail below. The voicing state includes silent, voiced, and unvoiced states. The NAVSAD system, for example, includes a non-acoustic sensor to detect the vibration of human tissue associated with speech. The non-acoustic sensor of an embodiment is a General Electromagnetic Movement Sensor (GEMS) as described briefly below and in detail in the Related Applications, but is not so limited. Alternative embodiments, however, may use any sensor that is able to detect human tissue motion associated with speech and is unaffected by environmental acoustic noise.

The GEMS is a radio frequency device (2.4 GHz) that allows the detection of moving human tissue dielectric interfaces. The GEMS includes an RF interferometer that uses homodyne mixing to detect small phase shifts associated with target motion. In essence, the sensor sends out weak electromagnetic waves (less than 1 milliwatt) that reflect off of whatever is around the sensor. The reflected waves are mixed with the original transmitted waves and the results analyzed for any change in position of the targets. Anything that moves near the sensor will cause a change in phase of the reflected wave that will be amplified and displayed as a change in voltage output from the sensor. A similar sensor is described by Gregory C. Burnett (1999) in "The physiological basis of glottal electromagnetic micropower sensors (GEMS) and their use in defining an excitation function for the human vocal tract"; Ph.D. Thesis, University of California at Davis.

Figure 4:
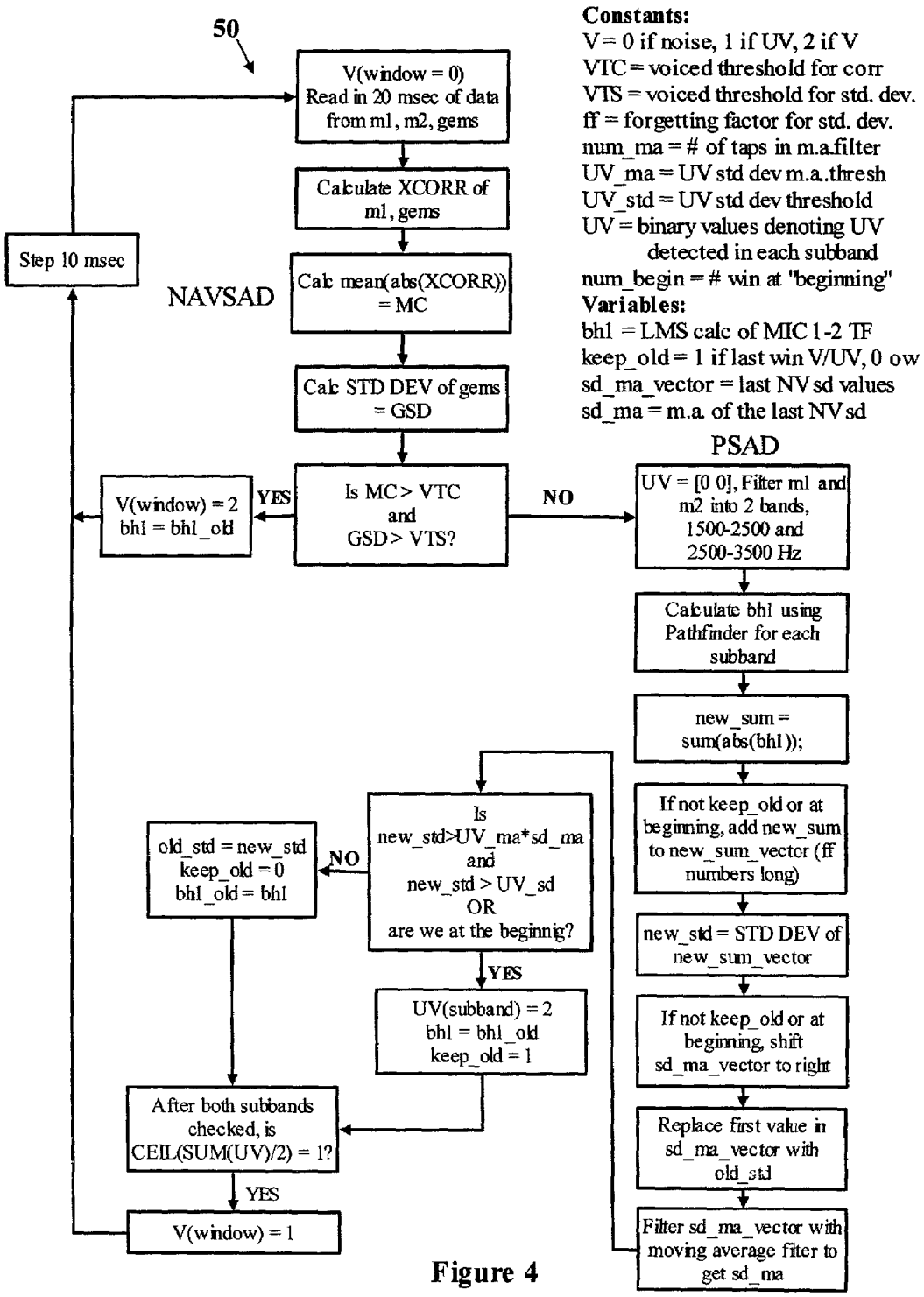
FIG. 4 is a flow diagram of a detection algorithm for use in detecting voiced and unvoiced speech, under an embodiment.

FIG. 4 is a flow diagram of a detection algorithm 50 for use in detecting voiced and unvoiced speech, under an embodiment. With reference to FIGS. 1 and 2, both the NAVSAD and PSAD systems of an embodiment include the detection algorithm 50 as the detection subsystem 50. This detection algorithm 50 operates in real-time and, in an embodiment, operates on 20 millisecond windows and steps 10 milliseconds at a time, but is not so limited. The voice activity determination is recorded for the first 10 milliseconds, and the second 10 milliseconds functions as a "look-ahead" buffer. While an embodiment uses the 20/10 windows, alternative embodiments may use numerous other combinations of window values.

Consideration was given to a number of multi-dimensional factors in developing the detection algorithm 50. The biggest consideration was to maintaining the effectiveness of the Pathfinder denoising technique, described in detail in the Related Applications and reviewed herein. Pathfinder performance can be compromised if the adaptive filter training is conducted on speech rather than on noise. It is therefore important not to exclude any significant amount of speech from the VAD to keep such disturbances to a minimum.

Consideration was also given to the accuracy of the characterization between voiced and unvoiced speech signals, and distinguishing each of these speech signals from noise signals. This type of characterization can be useful in such applications as speech recognition and speaker verification.

Furthermore, the systems using the detection algorithm of an embodiment function in environments containing varying amounts of background acoustic noise. If the non-acoustic sensor is available, this external noise is not a problem for voiced speech. However, for unvoiced speech (and voiced if the non-acoustic sensor is not available or has malfunctioned) reliance is placed on acoustic data alone to separate noise from unvoiced speech. An advantage inheres in the use of two microphones in an embodiment of the Pathfinder noise suppression system, and the spatial relationship between the microphones is exploited to assist in the detection of unvoiced speech. However, there may occasionally be noise levels high enough that the speech will be nearly undetectable and the acoustic-only method will fail. In these situations, the non-acoustic sensor (or hereafter just the sensor) will be required to ensure good performance.

In the two-microphone system, the speech source should be relatively louder in one designated microphone when compared to the other microphone. Tests have shown that this requirement is easily met with conventional microphones when the microphones are placed on the head, as any noise should result in an $H_1$ with a gain near unity.

Regarding the NAVSAD system, and with reference to FIG. 1 and FIG. 3, the NAVSAD relies on two parameters to detect voiced speech. These two parameters include the energy of the sensor in the window of interest, determined in an embodiment by the standard deviation (SD), and optionally the cross-correlation (XCORR) between the acoustic signal from microphone 1 and the sensor data. The energy of the sensor can be determined in any one of a number of ways, and the SD is just one convenient way to determine the energy.

For the sensor, the SD is akin to the energy of the signal, which normally corresponds quite accurately to the voicing state, but may be susceptible to movement noise (relative motion of the sensor with respect to the human user) and/or electromagnetic noise. To further differentiate sensor noise from tissue motion, the XCORR can be used. The XCORR is only calculated to 15 delays, which corresponds to just under 2 milliseconds at 8000 Hz.

The XCORR can also be useful when the sensor signal is distorted or modulated in some fashion. For example, there are sensor locations (such as the jaw or back of the neck) where speech production can be detected but where the signal may have incorrect or distorted time-based information. That is, they may not have well defined features in time that will match with the acoustic waveform. However, XCORR is more susceptible to errors from acoustic noise, and in high (<0 dB SNR) environments is almost useless. Therefore it should not be the sole source of voicing information.

The sensor detects human tissue motion associated with the closure of the vocal folds, so the acoustic signal produced by the closure of the folds is highly correlated with the closures. Therefore, sensor data that correlates highly with the acoustic signal is declared as speech, and sensor data that does not correlate well is termed noise. The acoustic data is expected to lag behind the sensor data by about 0.1 to 0.8 milliseconds (or about 1-7 samples) as a result of the delay time due to the relatively slower speed of sound (around 330 m/s). However, an embodiment uses a 15-sample correlation, as the acoustic wave shape varies significantly depending on the sound produced, and a larger correlation width is needed to ensure detection.

The SD and XCORR signals are related, but are sufficiently different so that the voiced speech detection is more reliable. For simplicity, though, either parameter may be used. The values for the SD and XCORR are compared to empirical thresholds, and if both are above their threshold, voiced speech is declared. Example data is presented and described below.

Figure 6:
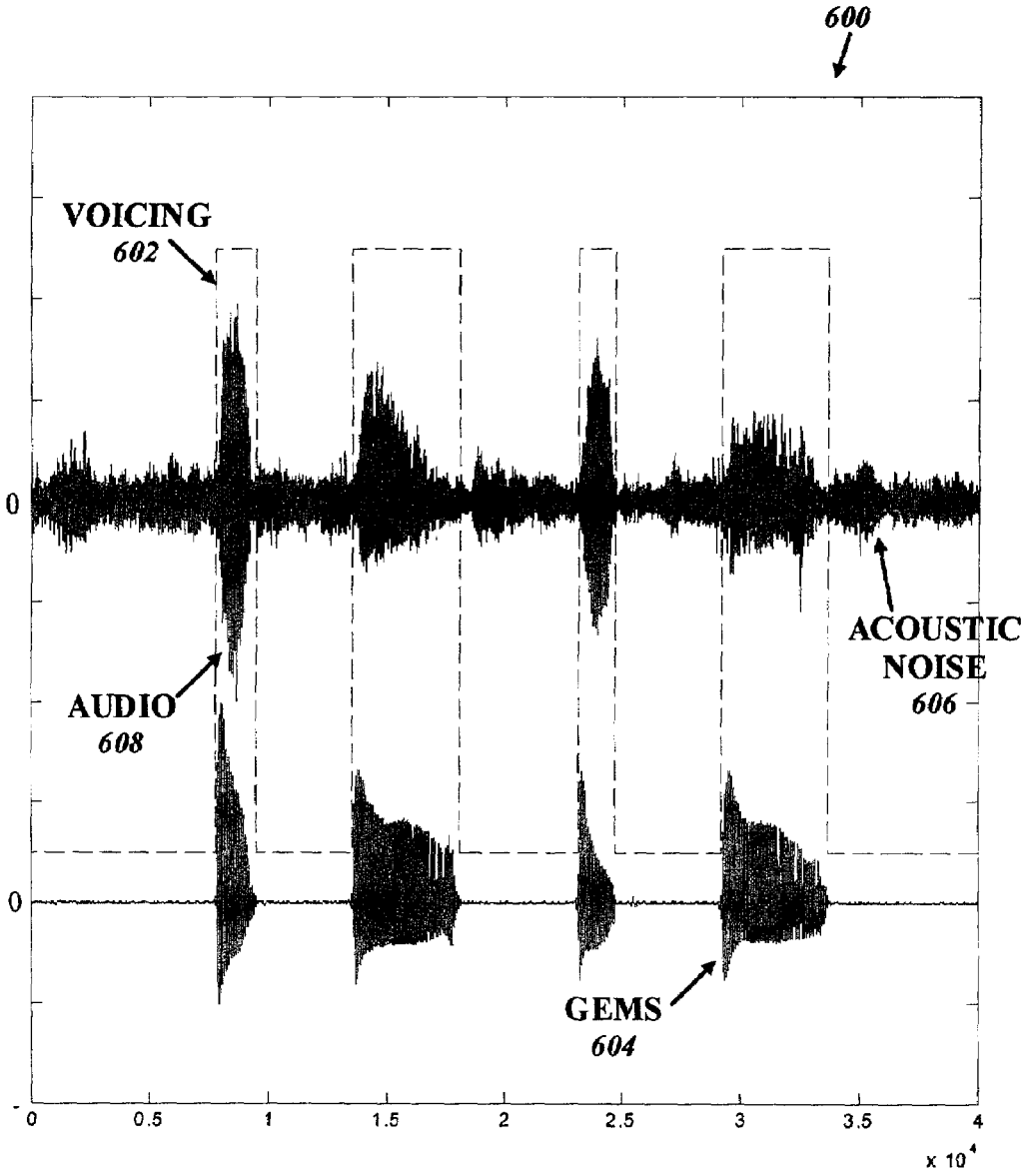
FIG. 6 plots voiced speech detected from an utterance along with the GEMS signal and the acoustic noise.

FIGS. 5A, 5B, and 6 show data plots for an example in which a subject twice speaks the phrase "pop pan", under an embodiment. FIG. 5A plots the received GEMS signal 502 for this utterance along with the mean correlation 504 between the GEMS signal and the Mic 1 signal and the threshold T1 used for voiced speech detection. FIG. 5B plots the received GEMS signal 502 for this utterance along with the standard deviation 506 of the GEMS signal and the threshold T2 used for voiced speech detection. FIG. 6 plots voiced speech 602 detected from the acoustic or audio signal 608, along with the GEMS signal 604 and the acoustic noise 606; no unvoiced speech is detected in this example because of the heavy background babble noise 606. The thresholds have been set so that there are virtually no false negatives, and only occasional false positives. A voiced speech activity detection accuracy of greater than 99% has been attained under any acoustic background noise conditions.

The NAVSAD can determine when voiced speech is occurring with high degrees of accuracy due to the non-acoustic sensor data. However, the sensor offers little assistance in separating unvoiced speech from noise, as unvoiced speech normally causes no detectable signal in most non-acoustic sensors. If there is a detectable signal, the NAVSAD can be used, although use of the SD method is dictated as unvoiced speech is normally poorly correlated. In the absence of a detectable signal use is made of the system and methods of the Pathfinder noise removal algorithm in determining when unvoiced speech is occurring. A brief review of the Pathfinder algorithm is described below, while a detailed description is provided in the Related Applications.

With reference to FIG. 3, the acoustic information coming into Microphone 1 is denoted by $m_1(n)$, the information coming into Microphone 2 is similarly labeled $m_2(n)$, and the GEMS sensor is assumed available to determine voiced speech areas. In the z (digital frequency) domain, these signals are represented as $M_1(z)$ and $M_2(z)$. Then $$M_1(z) = S(z) + N_2(z)$$

$$M_2(z) = N(z) + S_2(z)$$

with $$N_2(z) = N(z)H_1(z)$$

$$S_2(z) = S(z)H_2(z)$$

so that $$\begin{aligned} M_1(z) &= S(z) + N(z)H_1(z) \\ M_2(z) &= N(z) + S(z)H_2(z) \end{aligned} \tag{1}$$

This is the general case for all two microphone systems. There is always going to be some leakage of noise into Mic 1, and some leakage of signal into Mic 2. Equation 1 has four unknowns and only two relationships and cannot be solved explicitly.

However, there is another way to solve for some of the unknowns in Equation 1. Examine the case where the signal is not being generated—that is, where the GEMS signal indicates voicing is not occurring. In this case, s(n)=S(z) =0, and Equation 1 reduces to $$M_{1n}(z)=N(z)H_1(z)$$

$$M_{2n}(z)=N(z)$$

where the n subscript on the M variables indicate that only noise is being received. This leads to $$\begin{aligned} M_{1n}(z) &= M_{2n}(z)H_1(z) \\ H_1(z) &= \frac{M_{1n}(z)}{M_{2n}(z)} \end{aligned} \tag{2}$$

$H_1(z)$ can be calculated using any of the available system identification algorithms and the microphone outputs when only noise is being received. The calculation can be done adaptively, so that if the noise changes significantly $H_1(z)$ can be recalculated quickly.

With a solution for one of the unknowns in Equation 1, solutions can be found for another, $H_2(z)$, by using the amplitude of the GEMS or similar device along with the amplitude of the two microphones. When the GEMS indicates voicing, but the recent (less than 1 second) history of the microphones indicate low levels of noise, assume that n(s)=N(z)~0. Then Equation 1 reduces to $$M_{1s}(z)=S(z)$$

$$M_{2s}(z)=S(z)H_2(z)$$

which in turn leads to $$M_{2s}(z) = M_{1s}(z)H_2(z)$$

$$H_2(z) = \frac{M_{2s}(z)}{M_{1s}(z)}$$

which is the inverse of the $H_1(z)$ calculation, but note that different inputs are being used.

After calculating $H_1(z)$ and $H_2(z)$ above, they are used to remove the noise from the signal. Rewrite Equation 1 as $$S(z)=M_1(z)-N(z)H_1(z)$$

$$N(z)=M_2(z)-S(z)H_2(z)$$

$$S(z)=M_1(z)-[M_2(z)-S(z)H_2(z)]H_1(z),$$

$$S(z)[1-H_2(z)H_1(z)]=M_1(z)-M_2(z)H_1(z)$$

and solve for S(z) as:

$$S(z) = \frac{M_1(z) - M_2(z)H_1(z)}{1 - H_2(z)H_1(z)}. \quad (3)$$

In practice $H_2(z)$ is usually quite small, so that $H_2(z)H_1(z) \ll 1$, and $$S(z)\approx M_1(z)-M_2(z)H_1(z),$$

obviating the need for the $H_2(z)$ calculation.

With reference to FIG. 2 and FIG. 3, the PSAD system is described. As sound waves propagate, they normally lose energy as they travel due to diffraction and dispersion. Assuming the sound waves originate from a point source and radiate isotropically, their amplitude will decrease as a function of 1/r, where r is the distance from the originating point. This function of 1/r proportional to amplitude is the worst case, if confined to a smaller area the reduction will be less. However it is an adequate model for the configurations of interest, specifically the propagation of noise and speech to microphones located somewhere on the user's head.

Figure 7:
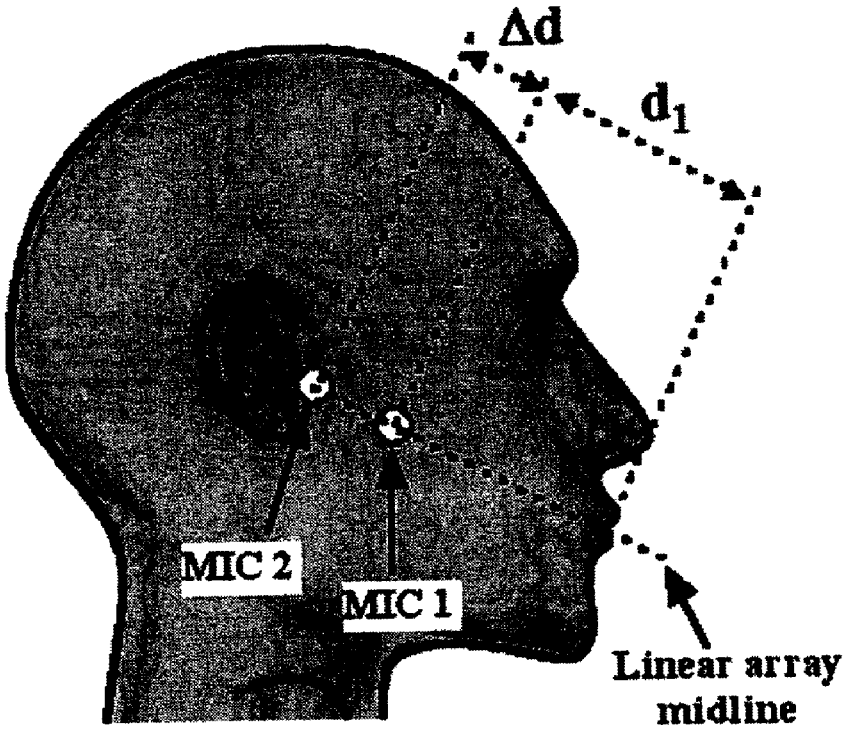
FIG. 7 is a microphone array for use under an embodiment of the PSAD system.

FIG. 7 is a microphone array for use under an embodiment of the PSAD system. Placing the microphones Mic 1 and Mic 2 in a linear array with the mouth on the array midline, the difference in signal strength in Mic 1 and Mic 2 (assuming the microphones have identical frequency responses) will be proportional to both $d_1$ and Δd. Assuming a 1/r (or in this case 1/d) relationship, it is seen that $$\Delta M = \frac{|Mic1|}{|Mic2|} = \Delta H_1(z) \propto \frac{d_1 + \Delta d}{d_1},$$

where ΔM is the difference in gain between Mic 1 and Mic 2 and therefore $H_1(z)$, as above in Equation 2. The variable $d_1$ is the distance from Mic 1 to the speech or noise source.

Figure 8:
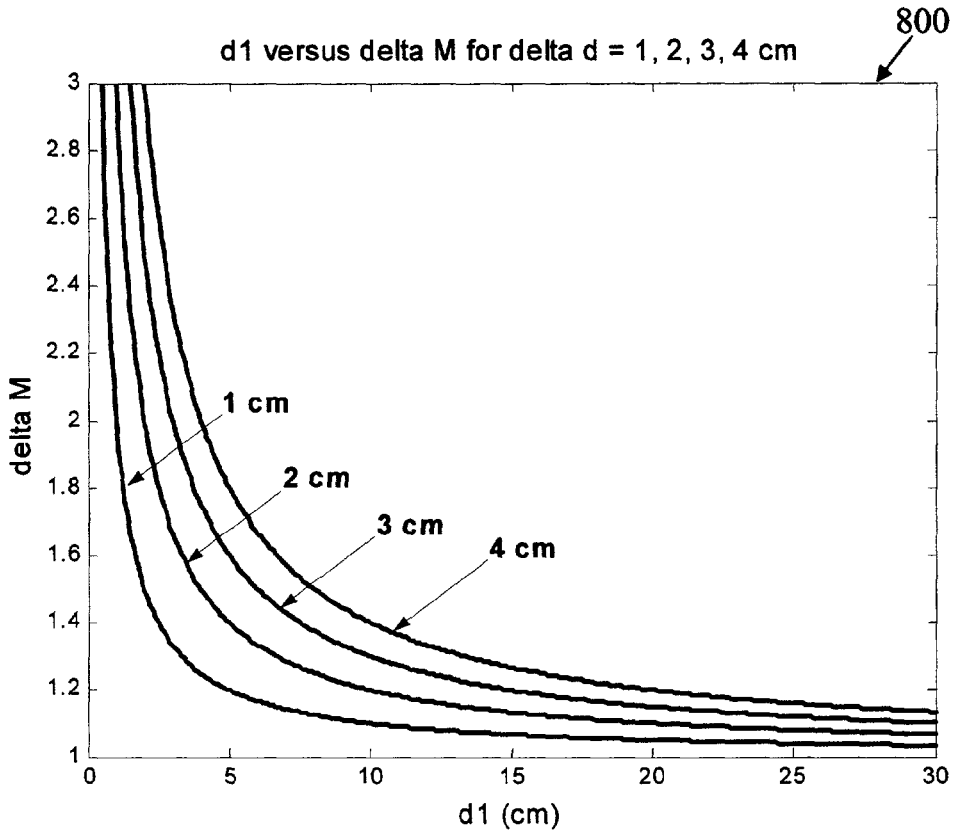
FIG. 8 is a plot of $\Delta M$ versus $d_1$ for several $\Delta d$ values, under an embodiment.

FIG. 8 is a plot 800 of ΔM versus $d_1$ for several Δd values, under an embodiment. It is clear that as Δd becomes larger and the noise source is closer, ΔM becomes larger. The variable Δd will change depending on the orientation to the speech/noise source, from the maximum value on the array midline to zero perpendicular to the array midline. From the plot 800 it is clear that for small Δd and for distances over approximately 30 centimeters (cm), ΔM is close to unity. Since most noise sources are farther away than 30 cm and are unlikely to be on the midline on the array, it is probable that when calculating $H_1(z)$ as above in Equation 2, ΔM (or equivalently the gain of $H_1(z)$) will be close to unity. Conversely, for noise sources that are close (within a few centimeters), there could be a substantial difference in gain depending on which microphone is closer to the noise.

If the "noise" is the user speaking, and Mic 1 is closer to the mouth than Mic 2, the gain increases. Since environmental noise normally originates much farther away from the user's head than speech, noise will be found during the time when the gain of $H_1(z)$ is near unity or some fixed value, and speech can be found after a sharp rise in gain. The speech can be unvoiced or voiced, as long as it is of sufficient volume compared to the surrounding noise. The gain will stay somewhat high during the speech portions, then descend quickly after speech ceases. The rapid increase and decrease in the gain of $H_1(z)$ should be sufficient to allow the detection of speech under almost any circumstances. The gain in this example is calculated by the sum of the absolute value of the filter coefficients. This sum is not equivalent to the gain, but the two are related in that a rise in the sum of the absolute value reflects a rise in the gain.

Figure 9:
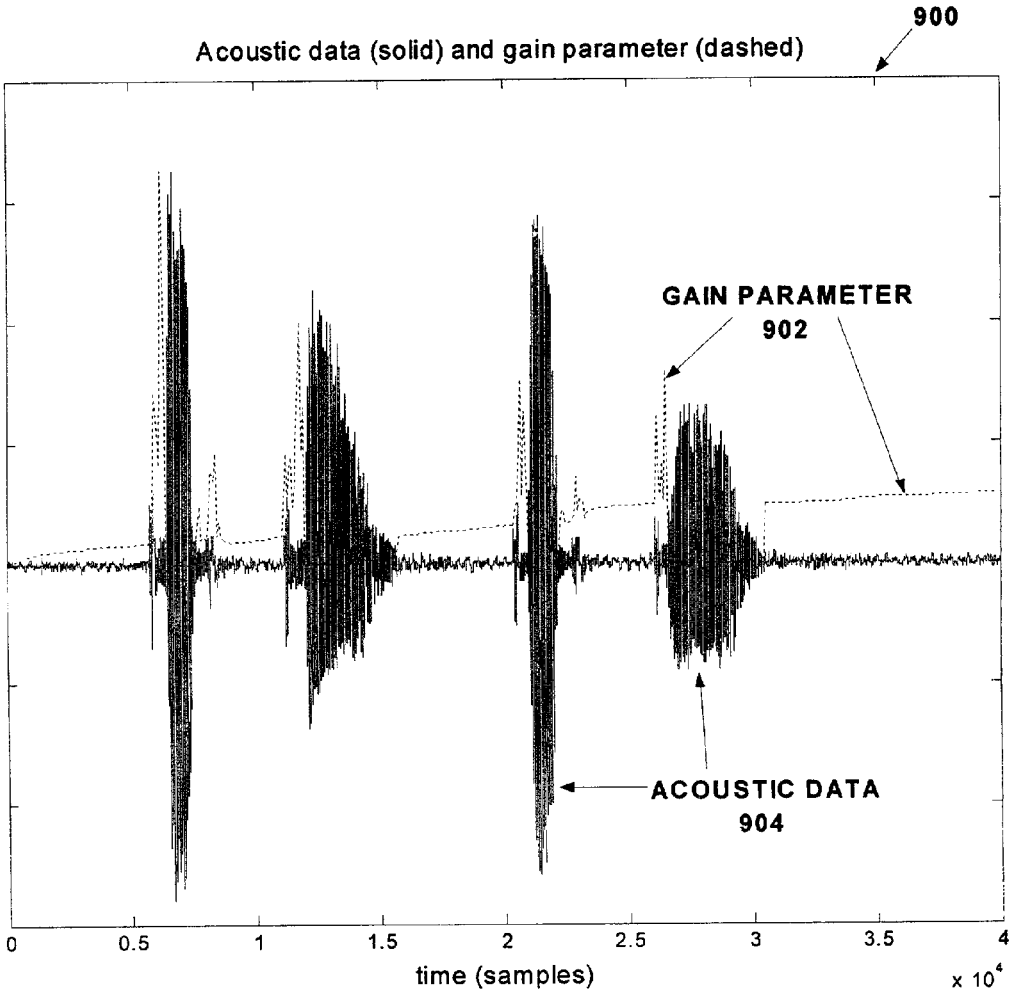
FIG. 9 shows a plot of the gain parameter as the sum of the absolute values of $H_1(z)$ and the acoustic data or audio from microphone 1.

As an example of this behavior, FIG. 9 shows a plot 900 of the gain parameter 902 as the sum of the absolute values of $H_1(z)$ and the acoustic data 904 or audio from microphone 1. The speech signal was an utterance of the phrase "pop pan", repeated twice. The evaluated bandwidth included the frequency range from 2500 Hz to 3500 Hz, although 1500Hz to 2500 Hz was additionally used in practice. Note the rapid increase in the gain when the unvoiced speech is first encountered, then the rapid return to normal when the speech ends. The large changes in gain that result from transitions between noise and speech can be detected by any standard signal processing techniques. The standard deviation of the last few gain calculations is used, with thresholds being defined by a running average of the standard deviations and the standard deviation noise floor. The later changes in gain for the voiced speech are suppressed in this plot 900 for clarity.

Figure 10:
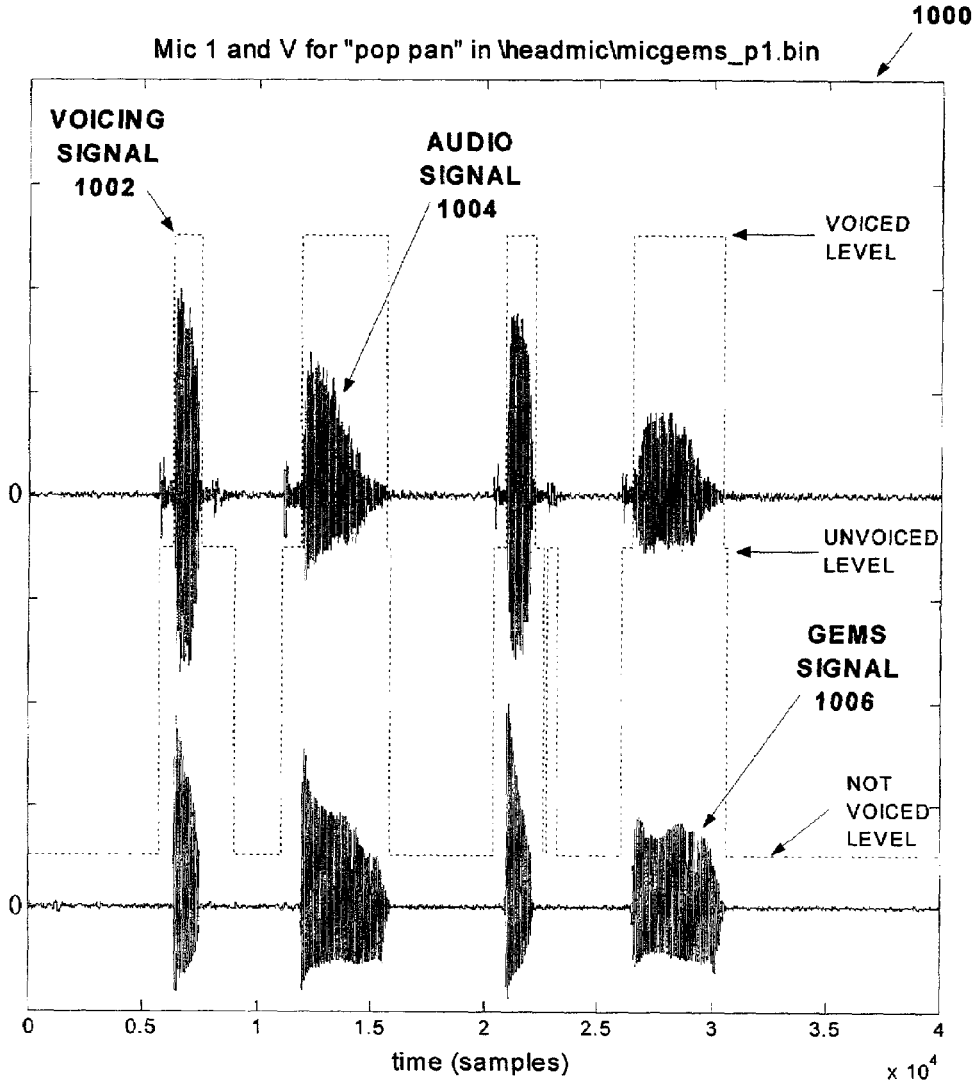
FIG. 10 is an alternative plot of acoustic data presented in FIG. 9.

FIG. 10 is an alternative plot 1000 of acoustic data presented in FIG. 9. The data used to form plot 900 is presented again in this plot 1000, along with audio data 1004 and GEMS data 1006 without noise to make the unvoiced speech apparent. The voiced signal 1002 has three possible values: 0 for noise, 1 for unvoiced, and 2 for voiced. Denoising is only accomplished when V=0. It is clear that the unvoiced speech is captured very well, aside from two single dropouts in the unvoiced detection near the end of each "pop". However, these single-window dropouts are not common and do not significantly affect the denoising algorithm. They can easily be removed using standard smoothing techniques.

What is not clear from this plot 1000 is that the PSAD system functions as an automatic backup to the NAVSAD. This is because the voiced speech (since it has the same spatial relationship to the mics as the unvoiced) will be detected as unvoiced if the sensor or NAVSAD system fail for any reason. The voiced speech will be misclassified as unvoiced, but the denoising will still not take place, preserving the quality of the speech signal.

However, this automatic backup of the NAVSAD system functions best in an environment with low noise (approximately 10+ dB SNR), as high amounts (10 dB of SNR or less) of acoustic noise can quickly overwhelm any acoustic-only unvoiced detector, including the PSAD. This is evident in the difference in the voiced signal data 602 and 1002 shown in plots 600 and 100 of FIGS. 6 and 10, respectively, where the same utterance is spoken, but the data of plot 600 shows no unvoiced speech because the unvoiced speech is undetectable. This is the desired behavior when performing denoising, since if the unvoiced speech is not detectable then it will not significantly affect the denoising process. Using the Pathfinder system to detect unvoiced speech ensures detection of any unvoiced speech loud enough to distort the denoising.

Regarding hardware considerations, and with reference to FIG. 7, the configuration of the microphones can have an effect on the change in gain associated with speech and the thresholds needed to detect speech. In general, each configuration will require testing to determine the proper thresholds, but tests with two very different microphone configurations showed the same thresholds and other parameters to work well. The first microphone set had the signal microphone near the mouth and the noise microphone several centimeters away at the ear, while the second configuration placed the noise and signal microphones back-to-back within a few centimeters of the mouth. The results presented herein were derived using the first microphone configuration, but the results using the other set are virtually identical, so the detection algorithm is relatively robust with respect to microphone placement.

A number of configurations are possible using the NAVSAD and PSAD systems to detect voiced and unvoiced speech. One configuration uses the NAVSAD system (non-acoustic only) to detect voiced speech along with the PSAD system to detect unvoiced speech; the PSAD also functions as a backup to the NAVSAD system for detecting voiced speech. An alternative configuration uses the NAVSAD system (non-acoustic correlated with acoustic) to detect voiced speech along with the PSAD system to detect unvoiced speech; the PSAD also functions as a backup to the NAVSAD system for detecting voiced speech. Another alternative configuration uses the PSAD system to detect both voiced and unvoiced speech.

While the systems described above have been described with reference to separating voiced and unvoiced speech from background acoustic noise, there are no reasons more complex classifications can not be made. For more in-depth characterization of speech, the system can bandpass the information from Mic 1 and Mic 2 so that it is possible to see which bands in the Mic 1 data are more heavily composed of noise and which are more weighted with speech. Using this knowledge, it is possible to group the utterances by their spectral characteristics similar to conventional acoustic methods; this method would work better in noisy environments.

As an example, the "k" in "kick" has significant frequency content form 500 Hz to 4000 Hz, but a "sh" in "she" only contains significant energy from 1700-4000 Hz. Voiced speech could be classified in a similar manner. For instance, an /i/ ("ee") has significant energy around 300 Hz and 2500 Hz, and an /a/ ("ah") has energy at around 900 Hz and 1200 Hz. This ability to discriminate unvoiced and voiced speech in the presence of noise is, thus, very useful.

Each of the steps depicted in the flow diagrams presented herein can itself include a sequence of operations that need not be described herein. Those skilled in the relevant art can create routines, algorithms, source code, microcode, program logic arrays or otherwise implement the invention based on the flow diagrams and the detailed description provided herein. The routines described herein can be provided with one or more of the following, or one or more combinations of the following: stored in non-volatile memory (not shown) that forms part of an associated processor or processors, or implemented using conventional programmed logic arrays or circuit elements, or stored in removable media such as disks, or downloaded from a server and stored locally at a client, or hardwired or preprogrammed in chips such as EEPROM semiconductor chips, application specific integrated circuits (ASICs), or by digital signal processing (DSP) integrated circuits.

Unless described otherwise herein, the information described herein is well known or described in detail in the Related Applications. Indeed, much of the detailed description provided herein is explicitly disclosed in the Related Applications; most or all of the additional material of aspects of the invention will be recognized by those skilled in the relevant art as being inherent in the detailed description provided in such Related Applications, or well known to those skilled in the relevant art. Those skilled in the relevant art can implement aspects of the invention based on the material presented herein and the detailed description provided in the Related Applications.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," and words of similar import, when used in this application, shall refer to this application as a whole and not to any particular portions of this application.

The above description of illustrated embodiments of the invention is not intended to be exhaustive or to limit the invention to the precise form disclosed. While specific embodiments of, and examples for, the invention are described herein for illustrative purposes, various equivalent modifications are possible within the scope of the invention, as those skilled in the relevant art will recognize. The teachings of the invention provided herein can be applied to signal processing systems, not only for the speech signal processing described above. Further, the elements and acts of the various embodiments described above can be combined to provide further embodiments.

All of the above references and Related Applications are incorporated herein by reference. Aspects of the invention can be modified, if necessary, to employ the systems, functions and concepts of the various references described above to provide yet further embodiments of the invention.

These and other changes can be made to the invention in light of the above detailed description. In general, in the following claims, the terms used should not be construed to limit the invention to the specific embodiments disclosed in the specification and the claims, but should be construed to include all speech signal systems that operate under the claims to provide a method for procurement. Accordingly, the invention is not limited by the disclosure, but instead the scope of the invention is to be determined entirely by the claims.

While certain aspects of the invention are presented below in certain claim forms, the inventor contemplates the various aspects of the invention in any number of claim forms. Thus, the inventor reserves the right to add additional claims after filing the application to pursue such additional claim forms for other aspects of the invention.

What I claim is:

1. A system for detecting voiced and unvoiced speech in acoustic signals having varying levels of background noise, comprising:

at least two microphones that receive the acoustic signals;

at least one voicing sensor that receives physiological information associated with human voicing activity; and at least one processor coupled among the microphones and the voicing sensor, wherein the at least one processor;

generates cross correlation data between the physiological information and an acoustic signal received at one of the two microphones;

identifies information of the acoustic signals as voiced speech when the cross correlation data corresponding to a portion of the acoustic signal received at the one receiver exceeds a correlation threshold;

generates difference parameters between the acoustic signals received at each of the two receivers, wherein the difference parameters are representative of the relative difference in signal gain between portions of the received acoustic signals;

identifies information of the acoustic signals as unvoiced speech when the difference parameters exceed a gain threshold; and identifies information of the acoustic signals as noise when the difference parameters are less than the gain threshold.

2. A method for removing noise from acoustic signals, comprising:

receiving the acoustic signals at two receivers and receiving physiological information associated with human voicing activity at a voicing sensor;

generating cross correlation data between the physiological information and an acoustic signal received at one of the two receivers;

identifying information of the acoustic signals as voiced speech when the cross correlation data corresponding to a portion of the acoustic signal received at the one receiver exceeds a correlation threshold;

generating difference parameters between the acoustic signals received at each of the two receivers, wherein the difference parameters are representative of the relative difference in signal gain between portions of the received acoustic signals;

identifying information of the acoustic signals as unvoiced speech when the difference parameters exceed a gain threshold; and identifying information of the acoustic signals as noise when the difference parameters are less than the gain threshold.

3. The method of claim 2, further comprising generating the gain threshold using standard deviations corresponding to the generation of the difference parameters.

4. The method of claim 2, further comprising performing denoising on the identified noise.

5. The method of claim 2, wherein the voicing sensor includes at least one detector selected from a group including radio frequency devices, electroglottographs, ultrasound devices, acoustic throat microphones, and airflow detectors.

* * * * *